US010043607B2

(12) United States Patent
Deligianni et al.

(10) Patent No.: US 10,043,607 B2
(45) Date of Patent: Aug. 7, 2018

(54) ELECTROLESSLY FORMED HIGH RESISTIVITY MAGNETIC MATERIALS

(71) Applicant: INTERNATIONAL BUSINESS MACHINES CORPORATION, Armonk, NY (US)

(72) Inventors: Hariklia Deligianni, Alpine, NJ (US); William J. Gallagher, Ardsley, NY (US); Yu Luo, Hopewell Junction, NY (US); Lubomyr T. Romankiw, Briancliff Manor, NY (US); Joonah Yoon, Poughkeepsie, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/143,992

(22) Filed: May 2, 2016

(65) Prior Publication Data

US 2017/0316855 A1 Nov. 2, 2017

(51) Int. Cl.

| | |
|---|---|
| ***H01F 1/153*** | (2006.01) |
| ***C23C 18/50*** | (2006.01) |
| ***C23C 18/16*** | (2006.01) |

(52) U.S. Cl.

CPC ..... *H01F 1/15308* (2013.01); *C23C 18/168* (2013.01); *C23C 18/1637* (2013.01); *C23C 18/50* (2013.01); *H01F 1/15333* (2013.01)

(58) Field of Classification Search

None

See application file for complete search history.

(56) References Cited

U.S. PATENT DOCUMENTS 4,325,733 A * 4/1982 Aboaf ..... C22C 45/04 148/304
6,340,533 B1 * 1/2002 Ueno ..... B32B 15/04 360/324.11

(Continued)

FOREIGN PATENT DOCUMENTS

JP 4811543 B2 11/2011

OTHER PUBLICATIONS

Munakata et al. (J. Mag. Soc. Jap., 26, 509-512, 2002). (Year: 2002).*

(Continued)

*Primary Examiner* — Kevin M Bernatz

(74) *Attorney, Agent, or Firm* — Cantor Colburn LLP; Vazken Alexanian

(57) ABSTRACT

Present disclosure relates to magnetic materials, chips having magnetic materials, and methods of forming magnetic materials. In certain embodiments, magnetic materials may include a seed layer, and a cobalt-based alloy formed on seed layer. The seed layer may include copper, cobalt, nickel, platinum, palladium, ruthenium, iron, nickel alloy, cobalt-iron-boron alloy, nickel-iron alloy, and any combination of these materials. In certain embodiments, the chip may include one or more on-chip magnetic structures. Each on-chip magnetic structure may include a seed layer, and a cobalt-based alloy formed on seed layer. In certain embodiments, method may include: placing a seed layer in an aqueous electroless plating bath to form a cobalt-based alloy on seed layer. In certain embodiments, the aqueous electroless plating bath may include sodium tetraborate, an alkali metal tartrate, ammonium sulfate, cobalt sulfate, ferric ammonium sulfate and sodium borohydride and has a pH between about 9 to about 13.

9 Claims, 8 Drawing Sheets

(56) References Cited

U.S. PATENT DOCUMENTS

| | | | | |
|---|---|---|---|---|
| 6,350,323 | B1 * | 2/2002 | Inoue | H01F 1/15308 148/304 |
| 8,513,750 | B2 | 8/2013 | Gardner et al. | |
| 8,846,529 | B2 | 9/2014 | Gallagher et al. | |
| 9,159,778 | B2 | 10/2015 | Wang et al. | |
| 9,437,668 | B1 * | 9/2016 | Deligianni | H01L 28/10 |
| 9,590,026 | B2 * | 3/2017 | Deligianni | H01L 28/10 |
| 9,653,352 | B2 * | 5/2017 | Wu | H01L 21/76877 |
| 2002/0153258 | A1 * | 10/2002 | Filas | H01L 27/08 205/119 |
| 2008/0029891 | A1 * | 2/2008 | Joo | H01L 21/76843 257/751 |
| 2008/0237051 | A1 * | 10/2008 | Park | C23C 18/1692 205/90 |
| 2008/0292876 | A1 * | 11/2008 | Choi | H01F 10/131 428/336 |
| 2009/0169874 | A1 * | 7/2009 | McCloskey | C25D 3/562 428/336 |
| 2013/0221460 | A1 * | 8/2013 | Jan | H01L 43/10 257/421 |
| 2014/0191362 | A1 * | 7/2014 | Gallagher | H01L 28/10 257/531 |
| 2015/0255529 | A1 | 9/2015 | Wang et al. | |
| 2015/0287772 | A1 | 10/2015 | Wang et al. | |
| 2015/0287773 | A1 | 10/2015 | Wang et al. | |
| 2015/0311430 | A1 * | 10/2015 | Singleton | H01L 43/08 257/421 |
| 2015/0311431 | A1 * | 10/2015 | Zhou | H01L 43/08 257/421 |
| 2016/0284786 | A1 * | 9/2016 | Deligianni | H01L 28/10 |
| 2016/0284787 | A1 * | 9/2016 | Deligianni | H01L 28/10 |

OTHER PUBLICATIONS

Chen et al. (J. Nan., vol. 2012, 1-5, 2012). (Year: 2012).*

Ma (Phys. Stat. Sol. A, 208(7), 1693-1697, 2011). (Year: 2011).*

C. Slonczewski et al, "Micromagnetics of Laminated Permalloy Films," IEEE Transactions on Magnetics, vol. 24, No. 3 pp. 2045-2054, (May 1988).

S. Bae, et al., "High Q Ni—Zn—Cu Ferrite Inductor for On-Chip Power Module," IEEE Transaction on Magnetics, vol. 45, No. 10, pp. 4773-4776, (Oct. 2009).

Viala, S. Couderc, A. S. Royet, P. Ancey, and G. Bouche, "Bidirectional Ferromagnetic Spiral Inductors Using Single Deposition," IEEE Transactions on Magnetics, vol. 41, No. 10, Oct. 2005, pp. 3544-3549.

X. Xing, et al., "RF Magnetic Properties of FeCoB/Al2O3/FeCoB Structure with varied Al2O3 Thickness," IEEE Transactions on Magnetics, vol. 47, No. 10, Oct. 2011 pp. 3104-3107.

Xing, N. X. Sun, and B. Chen, "High-Bandwidth Low-Insertion Loss Solenoid Transformers Using FeCoB Multilayers," IEEE Transactions on Power Electronics, vol. 28, No. 9, Sep. 2013, pp. 4395-4401.

He et al. "Kinetics Parameters Studies of Co—Fe—B Deposits using Multiple Regression," 2005 IEEE International Symposium on Microwave, Antenna, Propagation and EMC Technologies for Wireless Communications Proceedings, 2005, pp. 1480-1483.

List of IBM Patents or Patent Applications Treated as Related; (Appendix P), Filed Sep. 25, 2017; 2 pages.

Hariklia Deligianni et al., "Electrolessly Formed High Resistivity Magnetic Materials", U.S. Appl. No. 15/486,744, filed Apr. 13, 2017.

* cited by examiner

ELECTROLESSLY FORMED HIGH RESISTIVITY MAGNETIC MATERIALS

This invention was made with Government support under Contract No: N00014-13-C-0167 awarded by the Defense Advanced Research Projects Agency (DARPA). The Government has certain rights to this invention.

BACKGROUND

The present disclosure relates in general to forming magnetic materials, and more specifically to systems, methodologies and resulting device structures for forming magnetic materials by electrodeposition, wherein the desired characteristics of the magnetic material formed according to the present disclosure are influenced by the selection of the composition and the pH of the aqueous electrodeposition plating bath, along with the selection of the seed layer materials used in the electrodeposition.

On-chip magnetic inductors or transformers are passive elements that find wide applications in on-chip power converters and radio-frequency integrated circuits. On-chip magnetic inductors or transformers are composed of a set of conductors (e.g., copper lines) to carry the current, along with a magnetic core/yoke to store magnetic energy.

High performance magnetic core materials often determine the performance of the inductors both in inductance (L) and quality factor (Q), especially in the high frequency range (>10 MHz). The figures of merit for the soft magnetic materials used for on-chip inductors are high permeability, high moment, low coercivity, high anisotropy and high electrical resistivity.

Therefore, heretofore unaddressed needs still exist in the art to address the aforementioned deficiencies and inadequacies.

SUMMARY

The present invention relates to magnetic materials, methods of making the magnetic materials, and on-chip magnetic structures.

In one aspect, the present disclosure relates to a magnetic material. In certain embodiments, the magnetic material may include a seed layer, and a cobalt-based alloy formed on the seed layer. The seed layer may include copper, cobalt, nickel, platinum, palladium, ruthenium, iron, a nickel alloy, a cobalt-iron-boron alloy, a nickel-iron alloy, and any combination of these materials. In certain embodiments, the cobalt-based alloy may include an amorphous or a nanocrystalline microstructure. In certain embodiments, the cobalt-based alloy may include a CoFeB alloy. In certain embodiments, the cobalt-based alloy may include boron in an atomic percentage range between from about 25% to about 45%. In certain embodiments, the magnetic material has a magnetic coercivity in the range from about 0.1 to less than about 10 Oersted (Oe). In certain embodiments, the cobalt-based alloy has a thickness in the range from about 100 to about 500 nanometers, and the seed layer has a thickness in the range from about 50 to about 70 nanometers. In one embodiment, the resistivity of the magnetic material is greater than or equal to about 200 micro ohms centimeter. In another embodiment, the resistivity of the magnetic material is greater than or equal to about 1000 micro ohms centimeter.

In another aspect, the present disclosure relates to a method of making a magnetic material. In certain embodiments, the method may include: placing a seed layer in an aqueous electroless plating bath to form a cobalt-based alloy on the seed layer. In certain embodiments, the aqueous electroless plating bath may include sodium tetraborate, an alkali metal tartrate, ammonium sulfate, cobalt sulfate, ferric ammonium sulfate and sodium borohydride and the aqueous electroless plating bath has a pH in the range from about 9 to about 13. In certain embodiments, the sodium tetraborate may include a concentration in the range from about 0.005 moles per liter to about 0.02 moles per liter. The alkali metal tartrate may include a concentration in the range from about 0.222 moles per liter to 0.250 moles per liter. The ammonium sulfate comprises a concentration in the range of about 0.150 moles per liter to about 0.200 moles per liter, the cobalt sulfate may include a concentration of about 0.01 moles per liter to 0.04 moles per liter, the ferric ammonium sulfate comprises a concentration in the range from about 0.005 moles per liter to about 0.040 moles per liter and the sodium borohydride may include a concentration in the range from about 5 micromoles per liter to about 200 micromoles per liter.

In certain embodiments, the seed layer comprises copper, cobalt, nickel, platinum, palladium, ruthenium, iron, a nickel alloy, a cobalt-iron-boron alloy, a nickel-iron alloy, and any combination of these materials. The cobalt-based alloy has a thickness in the range from about 100 to about 500 nanometers and the seed layer has a thickness in the range from about 50 to about 70 nanometers. In certain embodiments, the aqueous electroless plating bath has a pH in the range from about 10.5 to about 12.5. In certain embodiments, the temperature of the aqueous electroless plating bath is in the range from about 25° C. to about 45° C.

In yet another aspect, the present disclosure relates to a chip. In certain embodiments, the chip may include one or more on-chip magnetic structures. Each of the one or more on-chip magnetic structures may include a seed layer, and a cobalt-based alloy formed on the seed layer. The seed layer may include copper, cobalt, nickel, platinum, palladium, ruthenium, iron, a nickel alloy, a cobalt-iron-boron alloy, a nickel-iron alloy, and any combination of these materials.

In certain embodiments, each of the one or more on-chip magnetic structures has a magnetic coercivity in the range from about 0.1 to less than about 10 Oersted (Oe). The cobalt-based alloy may include boron in an atomic percentage range between from about 25% to about 45%. In certain embodiments, the cobalt-based alloy has a thickness in the range from about 100 to about 500 nanometers. In certain embodiments, the seed layer has a thickness in the range from about 50 to about 70 nanometers. In one embodiment, each of the one or more on-chip magnetic structures has a resistivity greater than or equal to about 200 micro ohms centimeter. In another embodiment, each of the one or more on-chip magnetic structures has a resistivity greater than or equal to about 1000 micro ohms centimeter.

BRIEF DESCRIPTION OF THE DRAWINGS

The subject matter of the present disclosure is particularly pointed out and distinctly claimed in the claims at the conclusion of the specification. The forgoing and other features, and advantages of the one or more embodiments provided in the present disclosure are apparent from the following detailed description taken in conjunction with the accompanying drawings in which:

DETAILED DESCRIPTION

Figure 1:
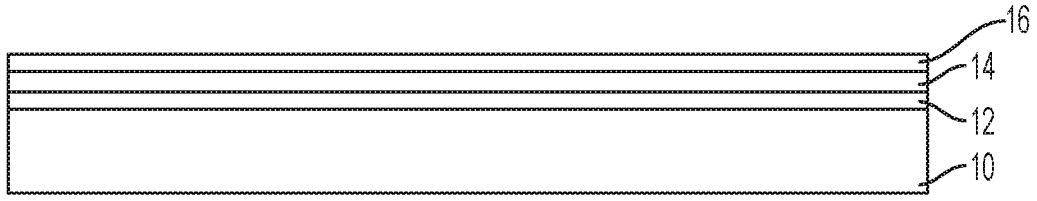
FIG. 1 is a cross-sectional view of a substrate having an adhesion layer, a seed layer and a protective layer formed thereon.

Various embodiments of the present disclosure are described herein with reference to the related drawings. Alternative embodiments may be devised without departing from the scope of this disclosure. It is noted that various connections and positional relationships (e.g., over, below, adjacent, etc.) are set forth between elements in the following description and in the drawings. These connections and/or positional relationships, unless specified otherwise, may be direct or indirect, and the present disclosure is not intended to be limiting in this respect. Accordingly, a coupling of entities may refer to either a direct or an indirect coupling, and a positional relationship between entities may be a direct or indirect positional relationship. As an example of an indirect positional relationship, references in the present disclosure to forming layer "A" over layer "B" include situations in which one or more intermediate layers (e.g., layer "C") is between layer "A" and layer "B" as long as the relevant characteristics and functionalities of layer "A" and layer "B" are not substantially changed by the intermediate layer(s).

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance, or illustration." Any embodiment or design described herein as "exemplary" is not necessarily to be construed as preferred or advantageous over other embodiments or designs. The terms "at least one" and "one or more" may be understood to include any integer number greater than or equal to one, i.e. one, two, three, four, etc. The terms "a plurality" may be understood to include any integer number greater than or equal to two, i.e. two, three, four, five, etc. The term "connection" may include both an indirect "connection" and a direct "connection."

For the sake of brevity, conventional techniques related to semiconductor device and IC fabrication may not be described in detail herein. Moreover, the various tasks and process steps described herein may be incorporated into a more comprehensive procedure or process having additional steps or functionality not described in detail herein. In particular, various steps in the manufacture of semiconductor devices and semiconductor-based ICs are well known and so, in the interest of brevity, many conventional steps will only be mentioned briefly herein or will be omitted entirely without providing the well-known process details.

Cobalt-based amorphous alloys such as CoZrTa, CoZrNb have been suggested as magnetic materials. In general, cobalt-based amorphous alloys have desirable magnetic properties and relatively high electrical resistivity. On-chip inductors employing such materials show favorable high-frequency response. Although the use of an electrodeposition technique in the formation of cobalt-based amorphous alloys would provide a variety of benefits, cobalt-based amorphous alloys are deposited mostly by vacuum deposition techniques (e.g. sputtering). This is because most transition metals are too noble to be reduced electrochemically in an aqueous solution as required by contemporary electrodeposition techniques.

Vacuum methods usually have low deposition rates, generally do not have good conformal coverage and the derived magnetic films are difficult to pattern subtractively due to the challenges of mask alignment and long etching times. Additionally, processing parameters for sputtering, such as low deposition rates and the need for frequent cleanings, may hinder integration of sputtering into the manufacturing process.

Turning now to an overview of the present disclosure, according to one or more embodiments disclosed herein there is provided a cobalt-based alloy magnetic material deposited on a seed layer according to a disclosed electroless-type electrodeposition process. In one or more embodiments, the cobalt-based alloy is CoFeB. In one or more embodiments, the CoFeB alloy is substantially amorphous. The electrolessly deposited cobalt-based alloy, and particularly the CoFeB amorphous alloy, has electrical and magnetic properties that are desirable over similar material that have been deposited by sputter type methods. For example, the disclosed electrolessly plated CoFeB alloy has a resistivity greater than 200 micro ohms centimeter and may have a resistivity greater than 1000 micro ohms centimeter.

According to one or more embodiments, the properties of the disclosed CoFeB alloy may be tailored through the selection of the pH of the aqueous electroless plating bath as well as the composition of the aqueous electroless plating bath as described in greater detail below. Electroless plating is, in general, similar to electroplating except that no outside current is needed. Electrons derived from heterogeneous oxidation of a reducing agent at a catalytically active surface reduce metal ions to form metal deposits on a surface. The electroless plating method according to one or more disclosed embodiments may be tailored through the composition of the aqueous electroless plating bath, the pH of the aqueous electroless plating bath and the selection of the seed layer material(s) to produce a magnetic material having a desired set of characteristics such as resistivity, permeability, coercivity, anisotropy and the like.

The magnetic material is useful as part of an on-chip structure. An exemplary on-chip structure is an inductor. Inductors allow for fine grain power control on a chip and/or in a wireless device, thus extending battery life.

Turning now to a more detailed description of one or more embodiments of the present disclosure, FIG. 1 is a cross-sectional view of a substrate 10 having an optional adhesion layer 12, a seed layer 14 and an optional protective layer 16 formed thereon. The substrate 10 is provided for the formation of a magnetic structure. The substrate 10 may be part of a wafer or may be a stand-alone substrate. The substrate 10 may include silicon or other substrate material such as GaAs, InP, SiC or the like. The optional adhesion layer 12 is disposed on the substrate 10 to facilitate formation of the seed layer 14 thereon. Exemplary materials for the adhesion layer include titanium, tantalum, tantalum nitride or a combination thereof.

In certain embodiments, the seed layer 14 may be formed on the optional adhesion layer 12 when presented directly on the substrate in the absence of the adhesion layer 12. In one embodiment, the seed layer 14 may be formed using a physical vapor deposition (PVD) process. Preferably the seed layer comprises materials that display magnetic properties.

Exemplary seed layer materials include copper, cobalt, nickel, platinum, palladium, ruthenium, iron, and alloys thereof. Some seed layer materials such as nickel, cobalt, palladium, and their alloys do not require activation. Other seed layer materials such as copper and copper alloys require an activation step in order to have sufficient catalytic activity to function as a seed layer for nucleation. In certain embodiments, the seed layer may include a nickel-iron alloy. In some embodiments the seed layer may include a cobalt-iron-boron alloy. The seed layer may have a thickness of about 50 to about 70 nanometers. The seed layer may be deposited in and possibly also post-annealed in a magnetic field to set its anisotropy direction.

The top protective layer 16, which is optional, may be employed to protect the seed layer 14 during processing. The top layer 16 may include titanium although any metal or even a non-metal may be used. The top protective layer may be deposited by physical vapor deposition or atomic layer deposition. The top protective layer 16 is typically removed just before electroless plating in order to provide a clean seed layer surface as the presence of materials such as oxidation products may interfere with electroless plating. If a top protective layer is not used then the surface of the seed layer 14 may be cleaned prior to electrodeposition.

Figure 2:
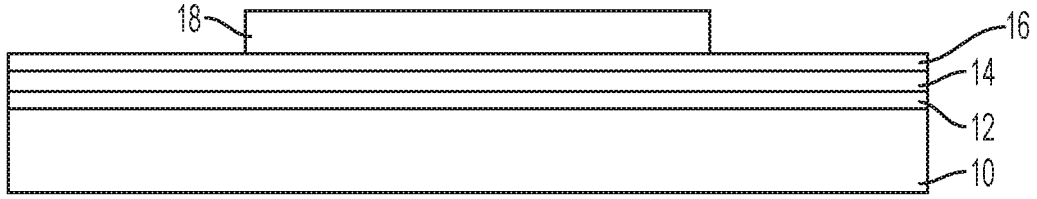
FIG. 2 is a cross-sectional view of the substrate of FIG. 1 having a lithographic resist mask formed thereon to pattern the seed layer.

Turning now to FIG. 2, a resist 18, such as a photoresist, is applied to the surface of the seed layer 14 or the top protective layer 16 when present. The resist 18 is patterned to reflect the desired shape of the seed layer 14.

Figure 3:
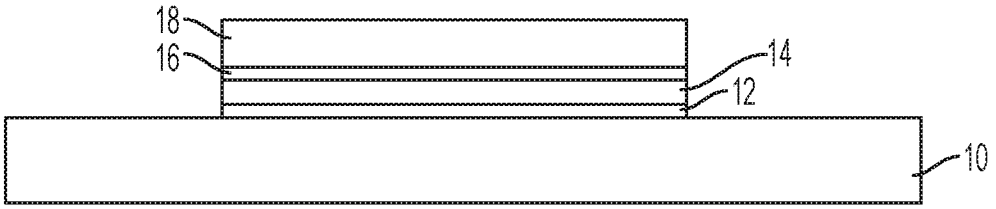
FIG. 3 is a cross-sectional view of the substrate of FIG. 2 having the adhesion layer, the seed layer and the protective layer patterned as described herein.

As shown in FIG. 3, lithographic patterning of the seed layer 14 (and top protective layer 16, adhesion layer 12 or both when present) results in a seed layer having the desired configuration. A wet etch may be employed to remove the portions of the seed layer 14 that are not covered by the resist 18.

In an alternate approach (not shown) instead of removing the seed layer, a portion of the seed layer may be isolated by covering other regions. For example, in FIG. 2, the top layers 16 may be treated (oxidized) to form an oxide (e.g., titanium oxide) or other compound. The resist 18 may be removed and the untreated top layer 16 may be removed to expose the clean seed layer in the appropriate shape.

Figure 4:
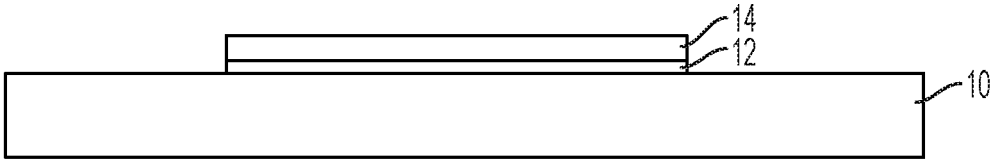
FIG. 4 is a cross-sectional view of the substrate of FIG. 3 having the resist layer and the protective layer removed.

After patterning is complete the resist 18 may be removed as well as the optional top protective layer 16 to expose the clean seed layer 14 surface as shown in FIG. 4. The CoFeB alloy is formed by submerging the structure of FIG. 4 in an aqueous electroless plating bath described below. The structure of FIG. 4 is typically submerged in the aqueous electroless plating bath for a time of about 15 minutes to about 45 minutes. Within this range the structure may be submerged for a time of about 25 minutes to about 35 minutes. The duration of submersion may impact the thickness of the CoFeB alloy deposited.

Figure 5:
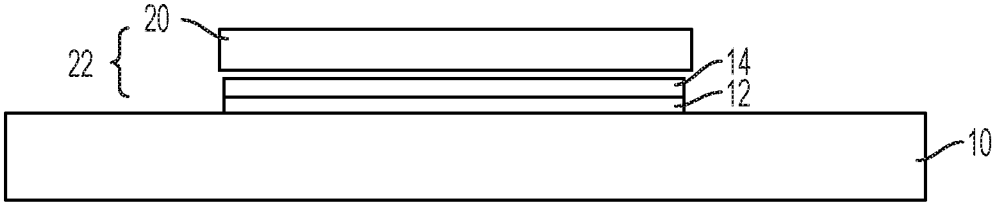
FIG. 5 is a cross-sectional view of the substrate of FIG. 4 having an electrolessly plated layer formed as described herein.

FIG. 5 shows the magnetic material 22. The magnetic material 22 includes the CoFeB alloy 20 disposed on the seed layer 14. The CoFeB alloy 20 may have a thickness of about 100 to about 500 nanometers. The magnetic material 22 is disposed on the optional adhesion layer 12 which is disposed on the substrate 10.

As previously noted herein, electroless plating is similar to electroplating except that no outside current is needed. Electrons derived from heterogeneous oxidation of a reducing agent at a catalytically active surface reduce metal ions to form metal deposits on a surface. The aspects of the electroless plating method described herein may include the specific composition of the aqueous electroless plating bath, the pH of the aqueous electroless plating bath and the selection of the seed layer material(s) to produce a magnetic material having a desired set of characteristics such as resistivity, permeability, coercivity, anisotropy and the like.

Figure 6:
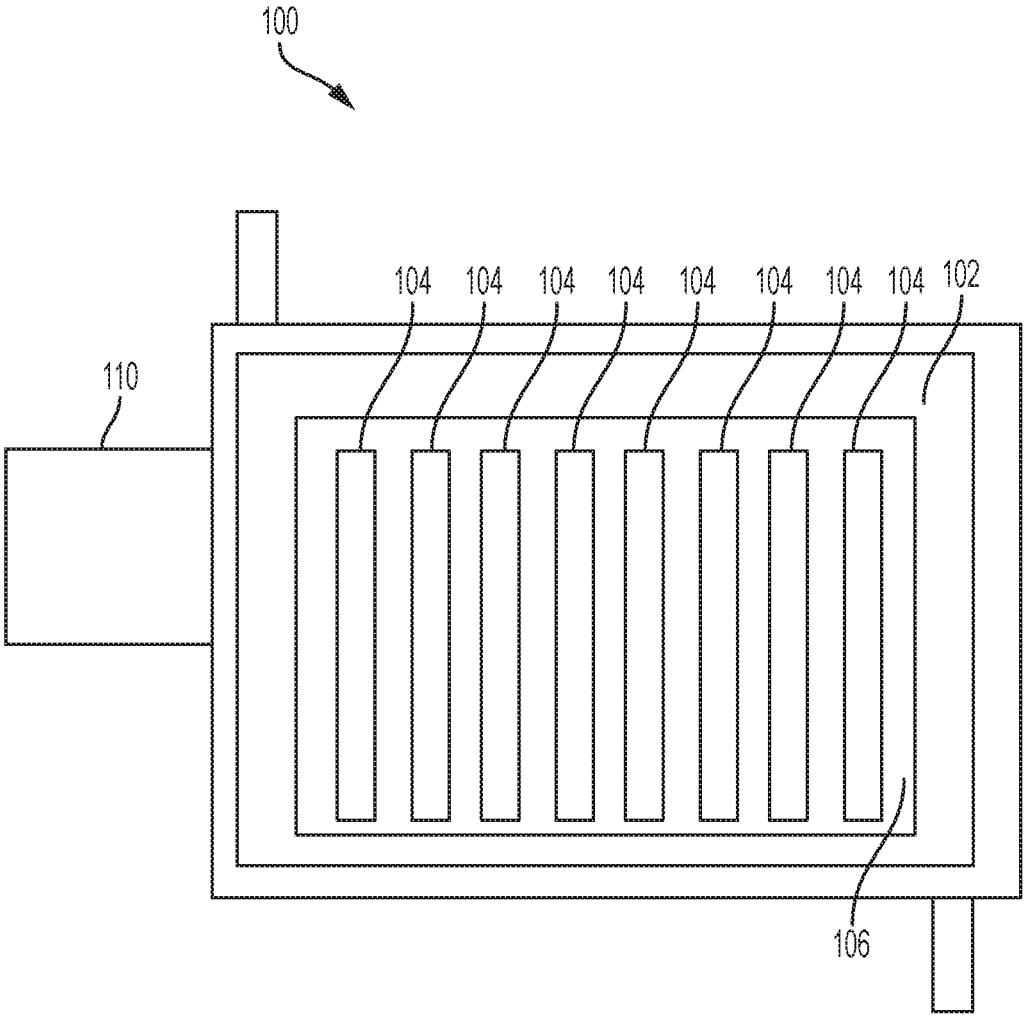
FIG. 6 is a schematic diagram showing an illustrative electroless bath.

Referring to FIG. 6, an illustrative electroless device 100 is shown in accordance with an exemplary embodiment. The device 100 includes an aqueous electroless plating bath 102. In one embodiment, multiple wafers 104 are batch processed to reduce time and costs. It should be understood that the wafers 104 may be arranged horizontally, vertically or at any angle in the device 100 using a holder or stand 106. It should also be understood that individual devices or substrates may be processed in the device as well.

A controller or computer device 110 may be employed to control conditions in the bath. For example, the controller 110 may control mixing (agitators or mixers (not shown)), control temperature (using thermocouple(s) and heaters (not shown)), control pH (by monitoring pH and introducing chemistries (e.g., buffers) as needed), etc. The controller 110 may also include alarms and timing controls to ensure high quality electroless plating parameters. Controller 110 may be implemented using one or more features of a computer system.

The aqueous electroless plating bath may include sodium tetraborate, an alkali metal tartrate, ammonium sulfate, cobalt sulfate, ferric ammonium sulfate and sodium borohydride. The aqueous electroless plating bath has a pH of about 9 to about 13. In some embodiments the aqueous electroless plating bath has a pH of 10.5 to 12.

The sodium tetraborate in the aqueous electroless plating bath may be in an amount of about 0.005 moles per liter (M) to about 0.02 moles per liter as a boron source. Within this range the amount of sodium tetraborate may be about 0.0095 moles per liter to about 0.0105 moles per liter. The sodium tetraborate may include anhydrous or a hydrate such as a pentahydrate or a decahydrate.

The alkali metal tartrate in the aqueous electroless plating bath may be in an amount of about 0.222 moles per liter to about 0.250 moles per liter. Within this range the amount of alkali metal tartrate may be about 0.235 moles per liter to about 0.245 moles per liter. The alkali metal tartrate may include sodium, potassium or a combination thereof. In a specific embodiment the alkali metal tartrate comprises potassium sodium tartrate typically available as potassium sodium tartrate tetrahydrate.

The ammonium sulfate in the aqueous electroless plating bath may be in an amount of about 0.150 moles per liter to about 0.200 moles per liter. Within this range the amount of ammonium sulfate may be about 0.185 moles per liter to about 0.195 moles per liter.

The cobalt sulfate in the aqueous electroless plating bath may be in an amount of about 0.01 moles per liter to 0.04 moles per liter as a cobalt source. Within this range the amount of cobalt sulfate may be about 0.01 moles per liter to about 0.03 moles per liter. The cobalt sulfate may include anhydrous or may be a hydrate such as a monohydrate, hexahydrate, heptahydrate or a combination including at least one of the foregoing. In certain embodiments the cobalt sulfate is cobalt sulfate heptahydrate.

The ferric ammonium sulfate in the aqueous electroless plating bath may be in an amount of about 0.005 moles per liter to about 0.040 moles per liter as the iron source. Within this range the amount of ferric ammonium sulfate may be about 0.008 moles per liter to about 0.030 moles per liter.

The sodium borohydride in the aqueous electroless plating bath may be in an amount of about 5 micromoles per liter to about 200 micromoles per liter as a reducing agent. Within this range the amount of sodium borohydride may be about 20 micromoles per liter to about 180 micromoles per liter. The amount of sodium borohydride present in the bath at a given pH may be used to tailor the properties of the CoFeB alloy. Higher levels of sodium borohydride can result in lower coercivity and higher resistivity. The amount of sodium borohydride may also affect the permeability loss tangent. Increased amounts of sodium borohydride may result in a material having a higher permeability loss tangent. A lower permeability loss tangent may be desired for high-frequency applications.

The pH of the aqueous electroless plating bath may also be used to tailor the properties of the CoFeB alloy. The pH may be about 9 to about 13. Within this range the pH may be about 10.5 to about 12, resulting in a CoFeB alloy with a higher amount of boron, typically an amount of about 30 atomic percent to about 40 atomic percent. A higher amount of boron appears to equate with a lower coercivity and higher anisotropy.

The temperature of the aqueous electroless plating bath may be about 25° C. to about 45° C. Within this range the temperature of the aqueous electroless plating bath may be about 30° C. to about 40° C. As mentioned above, the typical submersion time, i.e., the time to produce a CoFeB alloy having the desired thickness, is about 15 minutes to about 45 minutes. Within this range the structure may be submerged for a time of about 25 minutes to about 35 minutes.

The resulting magnetic material (CoFeB alloy disposed on a seed layer) has a resistivity of greater than or equal to 200 micro ohms centimeter. In some embodiments the resistivity is greater than or equal to about 800 micro ohms centimeter. In some embodiments the resistivity is greater than or equal to about 1000 micro ohms centimeter.

In certain embodiments, the CoFeB alloy may be electrolessly plated on a nickel-iron seed layer, and the resulting magnetic material may have a resistivity of about 200 to about 900 micro ohms centimeter. In certain embodiments, the CoFeB alloy may be electrolessly plated on a cobalt-iron-boron seed layer, and the resulting magnetic material may have a resistivity of about 400 to about 1550 micro ohms centimeter.

In certain embodiments, the seed layer may contain a nickel-iron alloy or a cobalt-iron-boron alloy, and the resulting magnetic material may have a magnetic coercivity of about 0.1 Oersted to less than about 10 Oersted (Oe), more specifically the magnetic material has a coercivity of about 0.25 Oersted to about 6 Oersted.

The CoFeB alloy may include iron in an amount of about 30 atomic percent to about 39 atomic percent. Within this range the amount of iron may be about 33 atomic percent to about 36 atomic percent.

The CoFeB alloy may include boron in an amount greater than 25 atomic percent. The CoFeB alloy may include boron in an amount less than 45 atomic percent. In general, scanning electron microscopy shows that the CoFeB alloy having a higher amount of boron is typically more amorphous and less columnar in the more crystalline regions. This type of microstructure appears to be consistent with higher resistivity values.

In some embodiments the magnetic material is composed of an electrolessly deposited CoFeB alloy disposed on a nickel-iron seed layer using an aqueous electroless plating bath having a pH of about 11 and a temperature of about 25° C. to about 35° C.

Electroless plating employs an inexpensive deposition setup with relatively inexpensive chemicals. Patterning is done on thin seed layers. Magnetic materials are selectively deposited on patterned seed layers so no plating molds are needed. High selectivity deposition results in small global stress, even on large scale wafers. Excellent conformal coverage is also achieved, and no current density distribution problems, often seen in electroplating processes, are present. The electroless deposition processes are efficient at uniformly depositing materials across large scale wagers (e.g., greater than 200 millimeters) and may even plate multiple waters simultaneously.

With the high electrical resistivity (greater than 200 micro ohms centimeter) and low coercivity the magnetic material provides good material properties for multiple magnetic applications. The relatively high electrical resistivity may provide the advantage of reducing eddy current losses during high frequency operations compared to commercial magnetic materials, and the relatively low coercivity allows a more immediate response to a change in magnetism, an important quality for materials used in magnetic applications.

Figure 7:
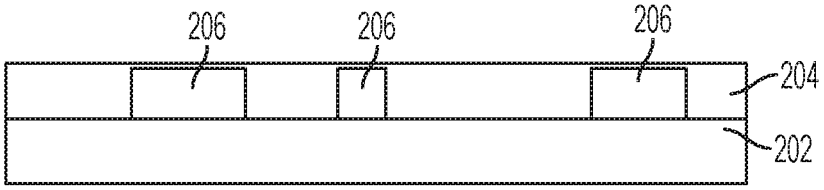
FIG. 7 is a cross-sectional view of a substrate having a dielectric layer with damascene metal structure formed therein.

Referring to FIGS. 7-12, another illustrative structure is described. Referring to FIG. 7, a substrate 202 has a dielectric layer 204 formed thereon. The substrate 202 may include any substrate material including but not limited to silicon, germanium, GaAs, quartz, sapphire, etc. The dielectric layer 204 may include silicon oxide, although other dielectric materials are also contemplated. The dielectric layer 204 may include patterned and conductive structures 206 formed using, e.g., a damascene process.

Figure 8:
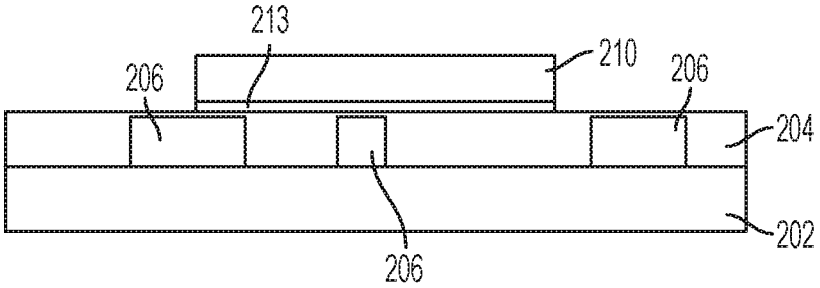
FIG. 8 is a cross-sectional view of the substrate of FIG. 7 having an electrolessly plated layer formed on a seed layer.

Referring to FIG. 8, a seed layer 213 is formed and patterned, then followed by an electroless plating process to form a CoFeB alloy bottom yoke 210. The seed layer 213 preferably includes a magnetic material and may be formed in the presence of a magnetic bias field. An adhesion layer may be employed and formed prior to the seed layer 213 but is not shown. The seed layer 213 may include a Ti layer patterned to the shape of the yoke 210 or the seed layer 213 may include a protective Ti layer thereon and oxidized in the field around the location for forming the yoke 210 where the Ti remains intact where a footprint of the yoke 210 is to be formed. This may include forming a patterned resist where the footprint of the yoke 210 is to be formed (to protect the Ti from oxidation).

Figure 9:
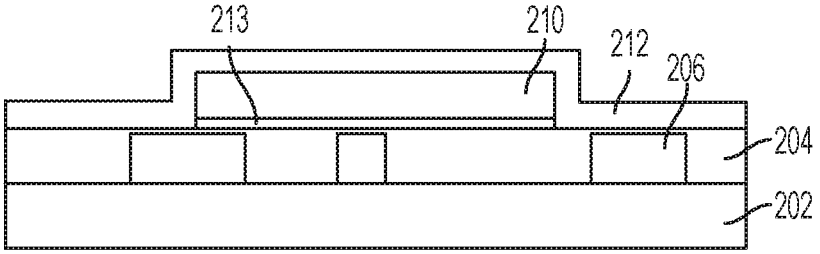
FIG. 9 is a cross-sectional view of the substrate of FIG. 8 having a dielectric layer formed on the plated layer.

Referring to FIG. 9, depending on the method of creating the seed layer 213, a field etch may be performed to remove the seed layer 213 from areas beyond the yoke 210. This may include a wet etch or other suitable etch process. A dielectric encapsulation layer 212 is formed over the yoke 210 and the field region surrounding the yoke 210. The dielectric encapsulation layer 212 may include an oxide such as tetraethyl orthosilicate (TEOS), or the like.

Figure 10:
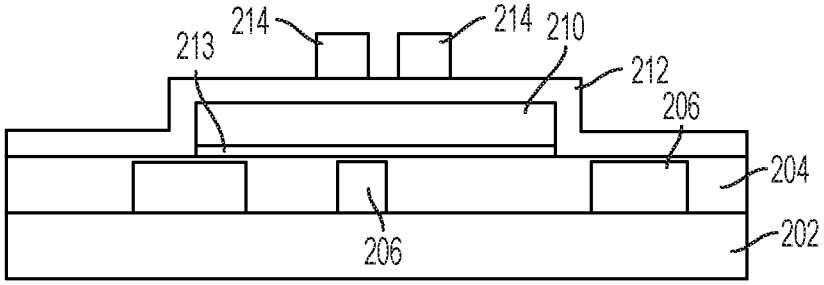
FIG. 10 is a cross-sectional view of the substrate of FIG. 9 having coils or structures formed over the plated layer on the dielectric layer.

Referring to FIG. 10, a mask (not shown) is formed over the yoke 210 on the layer 212. In certain embodiments, the mask is employed to form electroplated coils 214. The electroplated coils 214 may include copper or other metals. In certain embodiments, the coils 214 may also be formed by electroless processing.

Figure 11:
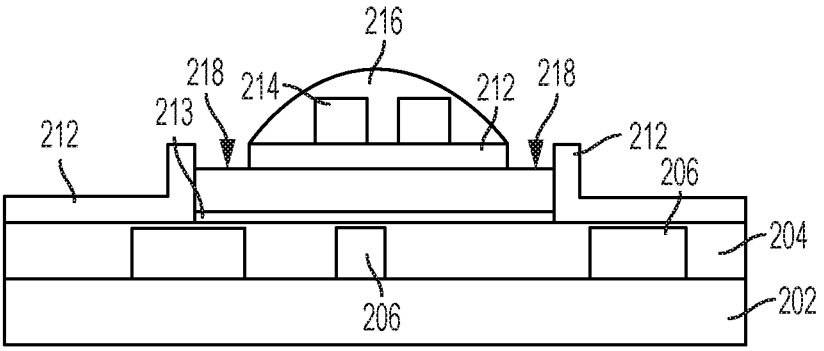
FIG. 11 is a cross-sectional view of the substrate of FIG. 10 having a hardbaked photoresist formed over the coils or structures, and openings formed in the dielectric layer to expose the plated layer.

Referring to FIG. 11, a photoresist 216 is deposited and patterned using a lithographic process to encapsulate the coils 214 over the yoke 210. The photoresist 216 is reflowed to obtain a domed or curved shape by relying on surface tension in the photoresist 216. Then, the photoresist 216 is hardbaked. Portions 218 of the layer 212 are opened up over the yoke 210. This may be performed using a patterned etch mask.

Figure 12:
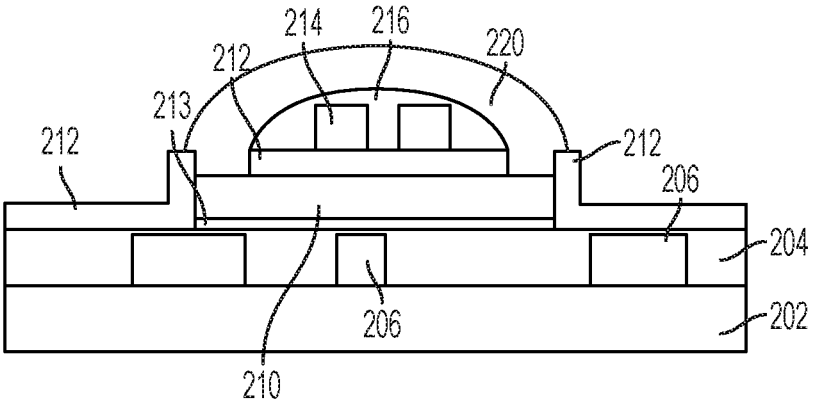
FIG. 12 is a cross-sectional view of the substrate of FIG. 11 having another plated layer formed over the hardbaked photoresist and the exposed portions of the plated layer.

Referring to FIG. 12, in certain embodiments, a top yoke 220 is formed by an electroless plating process using the bottom yoke 210 as a seed layer and growing the top yoke 220 over the hardbaked photoresist 216. The top yoke 220 preferably includes a same material as the bottom yoke 210 although different materials or alloys may be employed.

It should be understood that the yoke structure, the coils and the interconnections may be arranged in different shapes and configurations from those illustratively depicted in various figures.

Figure 13:
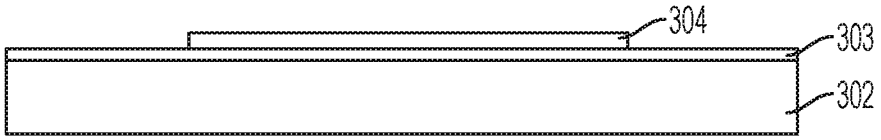
FIG. 13 is a cross-sectional view of a substrate having a patterned seed layer formed thereon in accordance with the present principles.

Referring to FIGS. 13-18, another illustrative structure is described, which employs a CoFeB alloy in a shielded slab inductor in accordance with the present principles. Referring to FIG. 13, a substrate 302 has a dielectric layer or adhesion layer 303 and a seed layer 304 formed thereon. The substrate 302 may include any substrate material including but not limited to silicon, germanium, GaAs, quartz, sapphire, etc. The seed layer 304 is patterned or otherwise processed to provide seed areas. The seed layer 304 may be activated, if needed. The dielectric layer 303 may include an oxide, e.g., $SiO_2$. An appropriate material may be selected for layer 303 to function as an adhesion layer as well.

Figure 14:
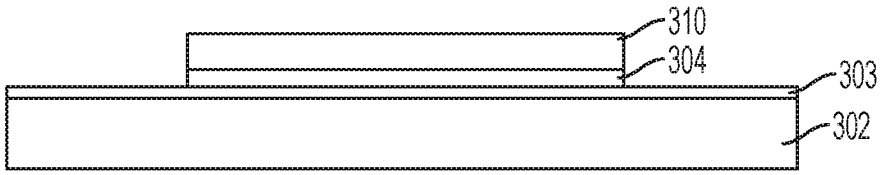
FIG. 14 is a cross-sectional view of the substrate of FIG. 13 having an electrolessly plated layer formed.

Referring to FIG. 14, in certain embodiments, a CoFeB alloy shield 310 is formed by an electroless plating process. It should be noted that the inductors, coils, slabs, shields, yokes or other structures depicted in the FIGS, are in cross-section and may include spirals, nested shapes, curves, etc. in top views.

Figure 15:
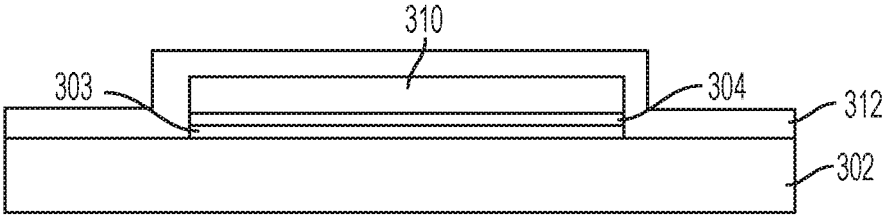
FIG. 15 is a cross-sectional view of the substrate of FIG. 14 having a dielectric layer formed over the plated layer.

Referring to FIG. 15, a dielectric layer 312 is deposited over the shield 310. The dielectric layer 312 may include an oxide, such as a silicon oxide, although other dielectric materials may be employed.

Figure 16:
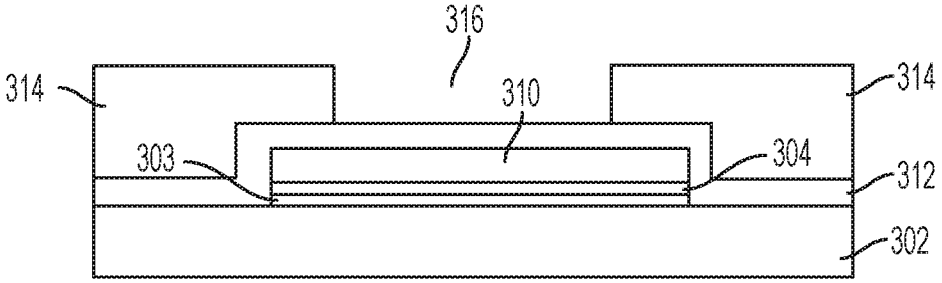
FIG. 16 is a cross-sectional view of the substrate of FIG. 15 having a resist layer patterned to form a mask or mold.

Referring to FIG. 16, a photoresist 314 is deposited over the dielectric layer 312 and is patterned to form a mask or mold for further processing. Further, an opening 316 is formed over the dielectric layer 312 for forming a slab inductor contact over the dielectric layer 312 and the shield 310.

Figure 17:
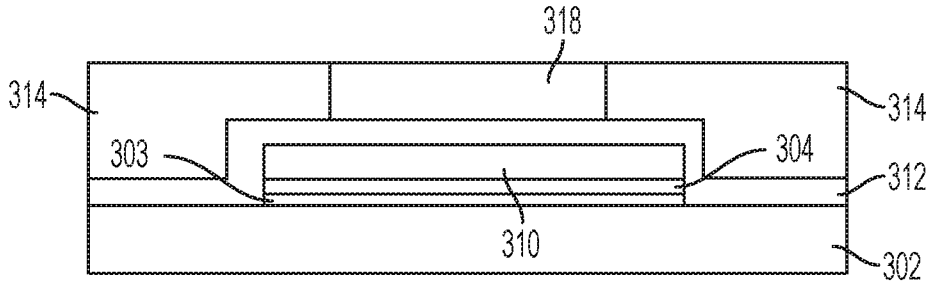
FIG. 17 is a cross-sectional view of the substrate of FIG. 16 having a conductive material formed in the mask or mold.
Figure 18:
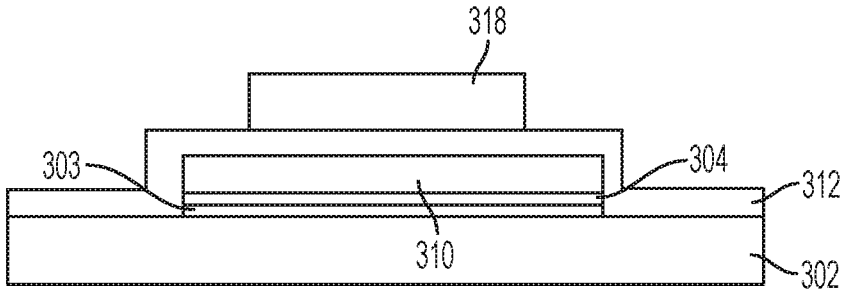
FIG. 18 is a cross-sectional view of the substrate of FIG. 17 after the mask or mold is removed to form a shielded slab inductor.

Referring to FIG. 17, in certain embodiments, a conductive material 318 is formed through the mask of photoresist 314 by an electroless plating process. The conductive material may include copper or other highly conductive material to form an inductor, inductor electrode and/or contact 318. The photoresist 314 is then removed as shown in FIG. 18 to provide a shielded-slab inductor structure in accordance with the present principles.

Figure 19:
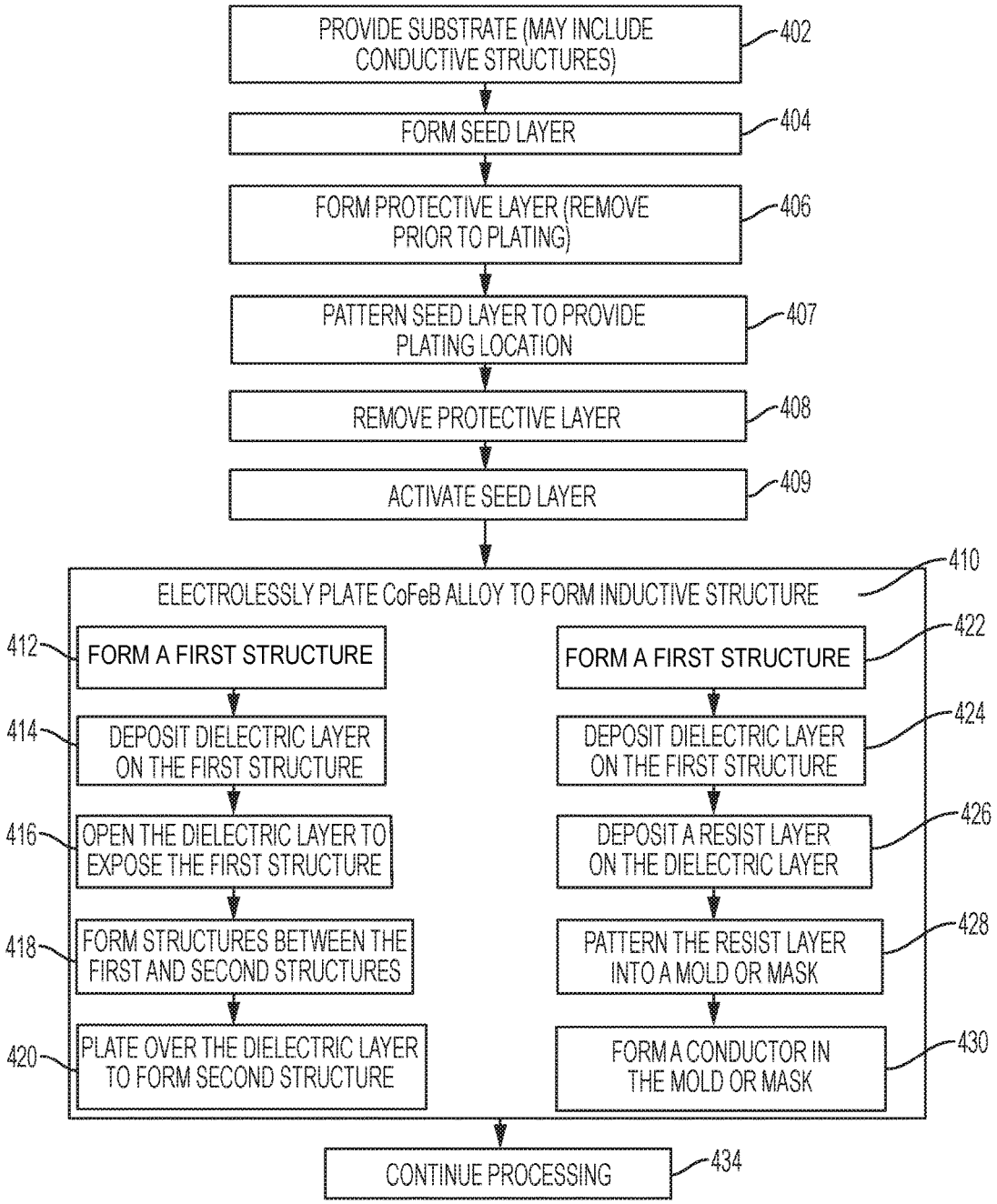
FIG. 19 is a block/flow diagram showing methods for forming an on-chip magnetic structure using electroless plating.

Referring to FIG. 19, methods for forming an on-chip magnetic structure using electroless plating process according to one or more embodiments are illustratively depicted. It should be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, may be implemented by special purpose hardware-based systems that perform the specified functions or acts, or combinations of special purpose hardware and computer instructions.

In block 402, a substrate is provided where a conductive material is to be formed. This may include depositing conductive structures, such as metal lines that may connect to the metal structure. In other embodiments, coils or inductive bodies may be formed in a dielectric layer as the case may be. In block 404, a seed layer is formed over a substrate of a semiconductor chip. The seed layer may be formed over a dielectric material, on a metal layer or on an adhesion layer. The metal/adhesion layer may include, e.g., Ti, Ta, TaN, etc. In block 406, a protective layer may be formed over the seed layer. The protective layer is removed in block 408 prior to subsequent electroless plating operations shown in block 410.

In block 407, the seed layer is patterned to provide a plating location. The patterning may employ lithographic patterning using a resist and wet etching. Other patterning techniques may also be employed. For example, a mask may be formed by lithography to cover plating locations and an oxidation process may be employed to oxidize the metal layer. Then, by removing the mask, the metal layer is ready for the plating while the oxidized metal is not.

In block 409, depending on the metal employed for the seed layer, an optional seed layer activation process may be employed. Activating may include coating or dipping the seed layer in a solution, e.g., a Pd-based solution.

In block 410, a CoFeB alloy is electrolessly plated at the plating location to form an inductive structure (or portion thereof) on the semiconductor chip. The inductive structure may include a yoke, a portion of a yoke, an inductor coil, a transformer coil or coils, rings, magnets, or any other magnetic structure or portions thereof.

Electrolessly plating includes: forming a first structure on the seed layer by electroless plating in block 412, depositing a dielectric material on the first structure in block 414; opening at least one opening in the dielectric material to expose a portion of the first structure in block 416; and electrolessly plating in block 420 over the dielectric layer by growing the CoFeB alloy over the dielectric layer from the at least one opening to form a second structure.

The first structure may include a bottom yoke and the second structure may include a top yoke, and conductors, such as, e.g., inductor coils may be formed on the dielectric layer between the bottom yoke and the top yoke in block 418.

In another embodiment, electrolessly plating includes: forming a first structure on the seed layer by electroless plating in block 422; depositing a dielectric material on the first structure in block 424; depositing a resist material on the dielectric layer in block 426; patterning the resist material to form a mask or mold in block 428; and forming a conductor in the mask or mold by plating in block 430. The first structure formed in block 422 may function as a magnetic shield for the conductor formed in block 430, and these together may function as a shielded-slab inductor.

Thus it can be seen from the foregoing detailed description and accompanying illustrations that one or more of the disclosed embodiments provide technical benefits and effects. The magnetic material (CoFeB alloy disposed on a seed layer) formed according to certain embodiments of the present invention may have a resistivity of greater than or equal to 200 micro ohms centimeter. In certain embodiments the resistivity is greater than or equal to about 800 micro ohms centimeter. In other embodiments the resistivity is greater than or equal to about 1000 micro ohms centimeter. In certain embodiments, when the CoFeB alloy is electrolessly plated on a nickel-iron seed layer, the resulting magnetic material may have a resistivity of about 200 to about 900 micro ohms centimeter, and when the CoFeB alloy is electrolessly plated on a cobalt-iron-boron seed layer, and the resulting magnetic material may have a resistivity of about 400 to about 1550 micro ohms centimeter. In certain embodiments, the seed layer may include a nickel-iron alloy or a cobalt-iron-boron alloy. The resulting magnetic material may have a magnetic coercivity of about 0.1 Oersted to less than about 10 Oersted (Oe), more specifically the resulting magnetic material may have a coercivity of about 0.25 Oersted to about 6 Oersted.

As used herein, the terms "invention" or "present invention" are non-limiting terms and not intended to refer to any single aspect of the particular invention but encompass all possible aspects as described in the specification and the claims.

As used herein, the term "about" modifying the quantity of an ingredient, component, or reactant of the invention employed refers to variation in the numerical quantity that may occur, for example, through typical measuring and liquid handling procedures used for making concentrates or solutions. Furthermore, variation may occur from inadvertent error in measuring procedures, differences in the manufacture, source, or purity of the ingredients employed to make the compositions or carry out the methods, and the like. In one aspect, the term "about" means within 10% of the reported numerical value. In another aspect, the term "about" means within 5% of the reported numerical value. Yet, in another aspect, the term "about" means within 10, 9, 8, 7, 6, 5, 4, 3, 2, or 1% of the reported numerical value.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A magnetic material comprising:

a seed layer having a metal selected from the group consisting of: copper, cobalt, nickel, platinum, palladium, ruthenium, iron, a nickel alloy, a cobalt-iron-boron alloy, and any combination thereof; and a magnetic layer consisting essentially of a cobalt-iron-boron alloy formed on the seed layer;

wherein the resistivity of the magnetic material is greater than or equal to about 1000 micro ohms centimeter.

2. The magnetic material of claim 1, wherein the magnetic layer cobalt-iron-boron alloy comprises an amorphous or a nano-crystalline micro structure.

3. The magnetic material of claim 1, wherein the cobalt-iron-boron alloy comprises boron in an atomic percentage in the range of between from about 25% to about 45%, and ranges therebetween.

4. The magnetic material of claim 1, wherein the magnetic material has a magnetic coercivity in the range from about 0.1 to less than about 10 Oersted (Oe), and ranges therebetween.

5. The magnetic material of claim 1, wherein the magnetic layer cobalt-iron-boron alloy has a thickness in the range from about 100 to about 500 nanometers, and ranges therebetween, and the seed layer has a thickness in the range from about 50 to about 70 nanometers, and ranges therebetween.

6. A chip comprising:

one or more on-chip magnetic structures, each of the one or more on-chip magnetic structures having:

a seed layer having a metal selected from the group consisting of: copper, cobalt, nickel, platinum, palladium, ruthenium, iron, a nickel alloy, a cobalt-iron-boron alloy, and any combination thereof; and a magnetic layer consisting essentially of a cobalt-iron-boron alloy formed on the seed layer;

wherein each of the one or more on chip magnetic structures has a resistivity greater than or equal to about 1000 micro ohms centimeter.

7. The chip of claim 6, wherein the magnetic layer cobalt-iron-boron alloy comprises boron in an atomic percentage range between from about 25% to about 45%, and ranges therebetween.

8. The chip of claim 6, wherein each of the one or more on-chip magnetic structures has a magnetic coercivity in the range from about 0.1 to less than about 10 Oersted (Oe), and ranges therebetween.

9. The chip of claim 6, wherein the magnetic layer cobalt-iron-boron alloy has a thickness in the range from about 100 to about 500 nanometers, and ranges therebetween, and the seed layer has a thickness in the range from about 50 to about 70 nanometers, and ranges therebetween.

* * * * *